US007138434B2

(12) United States Patent
Huff et al.

(10) Patent No.: US 7,138,434 B2
(45) Date of Patent: Nov. 21, 2006

(54) FISCHER-TROPSCH PROCESS

(75) Inventors: George Albert Huff, Naperville, IL (US); Barry Nay, Woking (GB)

(73) Assignees: BP Exploration Operating Company Limited, London (GB); Davy Process Technology Limited, London (GB)

( * ) Notice: Subject to any disclaimer, the term of this patent is extended or adjusted under 35 U.S.C. 154(b) by 129 days.

(21) Appl. No.: 10/477,212

(22) PCT Filed: May 17, 2002

(86) PCT No.: PCT/GB02/02321

§ 371 (c)(1),
(2), (4) Date: Nov. 10, 2003

(87) PCT Pub. No.: WO02/096836

PCT Pub. Date: Dec. 5, 2002

(65) Prior Publication Data

US 2004/0152794 A1 Aug. 5, 2004

(51) Int. Cl.
*C07C 27/00* (2006.01)

(52) U.S. Cl. ..... 518/712; 518/702; 518/703; 518/705; 518/715

(58) Field of Classification Search ..... 518/702, 518/703, 518, 712, 705, 715
See application file for complete search history.

(56) References Cited

U.S. PATENT DOCUMENTS

| | | | | |
|---|---|---|---|---|
| 4,579,985 | A * | 4/1986 | Minderhoud et al. | 585/310 |
| 5,776,988 | A | 7/1998 | Chaumette et al. | |
| 6,306,917 | B1 * | 10/2001 | Bohn et al. | 518/700 |

FOREIGN PATENT DOCUMENTS

| | | | |
|---|---|---|---|
| EP | 0 450 861 | A2 | 10/1991 |
| NL | 8 303 911 | A | 6/1985 |
| WO | WO 01/38269 | A1 | 5/2001 |

* cited by examiner

*Primary Examiner*—J. Parsa
(74) *Attorney, Agent, or Firm*—Nixon & Vanderhye

(57) ABSTRACT

Process for converting synthesis gas to higher hydrocarbons, at an elevated temperature and pressure. The process comprises continuously introducing a synthesis gas feed stream comprising 0.1 to 50% by volume of carbon dioxide into a continuous stirred reactor system comprising a reactor vessel containing a suspension of a solid particulate Fischer-Tropsch catalyst suspended in a liquid medium, wherein the solid particulate Fischer-Tropsch catalyst is stable in the presence of carbon dioxide.

30 Claims, No Drawings

FISCHER-TROPSCH PROCESS

This application is the U.S. National Phase of International Application PCT/GB02/02321, filed May 17, 2002, which designated the U.S.

The present invention relates to a process for the conversion of carbon monoxide and hydrogen (synthesis gas) to liquid hydrocarbon products in the presence of a Fischer-Tropsch catalyst.

BACKGROUND OF THE INVENTION

In the Fischer-Tropsch reaction a gaseous mixture of carbon monoxide and hydrogen is reacted in the presence of a catalyst to give a hydrocarbon mixture having a relatively broad molecular weight distribution. This product is predominantly straight chain, saturated hydrocarbons which typically have a chain length of more than 2 carbon atoms, for example, more than 5 carbon atoms.

It has recently been found that a Fischer-Tropsch process can be operated by dispersing a gaseous reactant stream comprising synthesis gas with a suspension of catalyst in a liquid medium in a continuous stirred reactor system. In such a continuous stirred reactor system, suspension is continuously introduced into a stirred reactor vessel and the rate of introduction of the suspension is balanced by the rate of withdrawal of suspension. Each increment of the suspension introduced into the stirred reactor vessel is mixed with the suspension already present in the reactor vessel and any variations in the composition of the suspension which may occur in the reactor vessel are averaged within time intervals shorter than the average residence time of the suspension within the reactor vessel resulting in the suspension being of substantially uniform composition. A gaseous reactant stream is continuously introduced into the reactor vessel while a gaseous purge stream is continuously removed either directly or indirectly from the reactor vessel. Any differences in the composition of the gaseous phase which is dispersed in the suspension are averaged within time intervals which are shorter than the average residence time of the gaseous phase within the suspension in the reactor vessel. Accordingly, the catalyst will be exposed to a uniform concentration of gaseous reactants. Mixing may be achieved within the reactor vessel by means of a mechanical agitator, for example a rotating impeller. Alternatively, mixing may be achieved by imparting turbulence to the suspension by passing the gaseous reactant stream and suspension through a high shear mixing zone, for example an injector mixing nozzle, wherein the gaseous stream is broken down into gas bubbles and/or irregularly shaped gas voids. The resulting mixture is then discharged into the reactor vessel where mixing is aided through the action of the gas bubbles and/or the irregularly shaped gas voids on the suspension. A Fischer-Tropsch process which employs such a turbulent continuous stirred reactor system is described in WO 0138269 (PCT patent application number GB 0004444).

Synthesis gas may contain high levels of carbon dioxide arising from the hydrocarbonaceous feedstock (for example, natural gas) employed in the synthesis gas production process or as a by-product of such a process. Many cobalt containing Fischer-Tropsch catalysts deactivate in the presence of even low concentrations of carbon dioxide. It may therefore be necessary to separate carbon dioxide from the synthesis gas before feeding the synthesis gas to a Fischer-Tropsch process. However, carbon dioxide may also arise as a by-product of the Fischer-Tropsch synthesis reaction. Where a Fischer-Tropsch process is operated using a fixed catalyst bed positioned in a plug flow tubular reactor, the concentration of carbon dioxide in the gas passing through the bed will increase with increasing distance along the bed. Consequently, the rate of deactivation of a susceptible catalyst will increase along the fixed bed. In contrast, in a continuous stirred reactor system, the catalyst will be exposed to a constant concentration of carbon dioxide. Consequently, a susceptible catalyst will decompose at a constant rate throughout the suspension. It is therefore critical that the catalyst used in a continuous stirred reactor system is stable to low amounts of carbon dioxide. It would also be advantageous to employ a catalyst which is stable in the presence of high amounts of carbon dioxide since this will avoid the need to separate carbon dioxide from the synthesis gas before the synthesis gas enters the continuous stirred reactor system.

SUMMARY OF THE INVENTION

Accordingly, the present invention relates to a process for converting synthesis gas to higher hydrocarbons, at an elevated temperature and pressure, comprising continuously introducing a synthesis gas feed stream comprising 0.1 to 50% by volume of carbon dioxide into a continuous stirred reactor system comprising a reactor vessel containing a suspension of a solid particulate Fischer-Tropsch catalyst suspended in a liquid medium wherein the solid particulate Fischer-Tropsch catalyst is stable in the presence of carbon dioxide.

Suitably, a suspension feed stream comprising the solid particulate Fischer-Tropsch catalyst suspended in the liquid medium is continuously introduced into the reactor system.

Suitably, a suspension product stream comprising the solid particulate catalyst suspended in the liquid medium and those higher hydrocarbons which are liquid at the conditions of elevated temperature and pressure, is continuously withdrawn from the reactor system.

Suitably, a gaseous exit stream comprising unconverted synthesis gas, water vapour, carbon dioxide, methane, inert gases (for example, nitrogen) and those higher hydrocarbons which are gaseous at the conditions of elevated temperature and pressure, is continuously withdrawn from the reactor system.

Suitably, the process of the present invention may be carried out in a reactor system as described in PCT patent application number GB 0004444 which approximates to a continuous stirred reactor system. Thus, the continuous stirred reactor system may comprise at least one high shear mixing zone and a reactor vessel. Suitably, the process of the present invention is operated by passing the suspension feed stream through the high shear mixing zone(s) where suspension is mixed with synthesis gas comprising 0.1 to 50% by volume of carbon dioxide. The shearing forces exerted on the suspension feed stream in the high shear mixing zone(s) are sufficiently high that the synthesis gas is broken down into gas bubbles and/or irregularly shaped gas voids which are dispersed within the suspension. The resulting mixture comprising suspension and gas bubbles and/or irregularly shaped gas voids dispersed therein is then discharged from the high shear mixing zone(s) into the reactor vessel where mixing is aided through the action of the gas bubbles and/or irregularly shaped gas voids on the suspension.

The reactor vessel may comprise a tank reactor or a tubular loop reactor comprising a tubular loop conduit.

The high shear mixing zone(s) may be part of the continuous stirred reactor system inside or outside the reactor vessel, for example, the high shear mixing zone(s) may project through the walls of the reactor vessel such that the high shear mixing zone(s) discharges its contents into the reactor vessel. Where, the high shear mixing zone(s) projects through the walls of the reactor vessel it may be necessary to recycle suspension from the reactor vessel to the high shear mixing zone(s) through a slurry line. Preferably, the continuous stirred reactor system comprises up to 250 high shear mixing zones, more preferably less than 100, most preferably less than 50, for example 10 to 50 high shear mixing zones. Preferably, the high shear mixing zones discharge into or are located within a single reactor vessel as described in WO 0138269 (PCT patent application number GB 0004444). It is also envisaged that 2 or 3 such continuous stirred reactor systems may be employed in series.

Suitably, the shearing forces exerted on the suspension in the high shear mixing zone(s) are sufficiently high that at least a portion of the synthesis gas feed stream is broken down into gas bubbles having diameters in the range of from 1 μm to 10 mm, preferably from 30 μm to 3000 μm, more preferably from 30 μm to 300 μm.

Without wishing to be bound by any theory, it is believed that any irregularly shaped gas voids are transient in that they are coalescing and fragmenting on a rapid time scale, for example, over a period of up to 500 ms. The gas voids have a wide size distribution with smaller gas voids having an average diameter of 1 to 2 mm and larger gas voids having an average diameter of 10 to 15 mm.

Suitably, the kinetic energy dissipation rate in the high shear mixing zone(s) is at least 0.5 $kW/m^3$ relative to the total volume of suspension present in the system, preferably in the range 0.5 to 25 $kW/m^3$, more preferably 0.5 to 10 $kW/m^3$, most preferably 0.5 to 5 $kW/m^3$, and in particular, 0.5 to 2.5 $kW/m^3$ relative to the total volume of suspension present in the system.

Suitably, the volume of suspension present in the high shear mixing zone(s) is substantially less than the volume of suspension present in the reactor vessel, for example, less than 20%, preferably less than 10% of the volume of suspension present in the reactor vessel.

The high shear mixing zone(s) may comprise any device suitable for intensive mixing or dispersing of a gaseous stream in a suspension of solids in a liquid medium, for example, a rotor-stator device, an injector-mixing nozzle or a high shear pumping means capable of breaking down a synthesis gas stream into gas bubbles and/or irregularly shaped gas voids.

The injector-mixing nozzle(s) can advantageously be executed as a venturi tube (c.f. "Chemical Engineers' Handbook" by J. H. Perry, 3rd edition (1953), p. 1285, FIG. 61), preferably an injector mixer (c.f. "Chemical Engineers' Handbook" by J H Perry, 3rd edition (1953), p 1203, FIG. 2 and "Chemical Engineers' Handbook" by R H Perry and C H Chilton 5th edition (1973) p 6–15, FIGS. 6–31) or most preferably as a liquid-jet ejector (c.f "Unit Operations" by G G Brown et al, 4th edition (1953), p. 194, FIG. 210).

Alternatively, the injector-mixing nozzle may be executed as a venturi plate. The venturi plate may be positioned transversely within an open ended conduit which discharges suspension containing gas bubbles and/or irregularly shaped gas voids dispersed therein into the reactor vessel. Preferably, the synthesis gas feed stream is injected into the open ended conduit downstream of the venturi plate, for example, within 1 metres, preferably, within 0.5 metres of the venturi plate.

The injector-mixing nozzle(s) may also be executed as a "gas blast" or "gas assist" nozzle where gas expansion is used to drive the nozzle (c.f. "Atomisation and Sprays" by Arthur H Lefebvre, Hemisphere Publishing Corporation, 1989). Where the injector-mixing nozzle(s) is executed as a "gas blast" or "gas assist" nozzle, the suspension of catalyst is fed to the nozzle at a sufficiently high pressure to allow the suspension to pass through the nozzle while the synthesis gas is fed to the nozzle at a sufficiently high pressure to achieve high shear mixing within the nozzle.

The high shear mixing zone(s) may also comprise a high shear pumping means, for example, a paddle or propeller having high shear blades positioned within an open ended conduit which discharges suspension containing gas bubbles and/or irregularly shaped gas voids into the reactor vessel. Preferably, the high shear pumping means is located at or near the open end of the conduit, for example, within 1 metre, preferably within 0.5 metres of the open end of the conduit. The synthesis gas feed stream maybe injected into the conduit, for example, via a sparger, located immediately upstream or downstream, preferably upstream of the high shear pumping means, for example, within 1 metre, preferably, within 0.5 metres of the high shear pumping means. Without wishing to be bound by any theory, the injected synthesis gas feed stream is broken down into gas bubbles and/or irregularly shaped gas voids (hereinafter "gas voids") by the fluid shear imparted to the suspension by the high shear pumping means.

Where the injector mixing nozzle(s) is executed as a venturi nozzle (either a conventional venturi nozzle or as a venturi plate), the pressure drop of the suspension over the venturi nozzle is typically in the range of from 1 to 40 bar, preferably 2 to 15 bar, more preferably 3 to 7 bar, most preferably 3 to 4 bar. Preferably, the ratio of the volume of gas ($Q_g$) to the volume of liquid ($Q_1$) passing through the venturi nozzle is in the range 0.5:1 to 10:1, more preferably 1:1 to 5:1, most preferably 1:1 to 2.5:1, for example, 1:1 to 1.5:1 (where the ratio of the volume of gas ($Q_g$) to the volume of liquid ($Q_1$) is determined at the desired reaction temperature and pressure).

Where the injector mixing nozzle(s) is executed as a gas blast or gas assist nozzle, the pressure drop of gas over the nozzle is preferably in the range 3 to 100 bar and the pressure drop of suspension over the nozzle is preferably in the range of from 1 to 40 bar, preferably 4 to 15, most preferably 4 to 7. Preferably, the ratio of the volume of gas ($Q_g$) to the volume of liquid ($Q_1$) passing through the gas blast or gas assist nozzle(s) is in the range 0.5:1 to 50:1, preferably 1:1 to 10:1 (where the ratio of the volume of gas ($Q_g$) to the volume of liquid ($Q_1$) is determined at the desired reaction temperature and pressure).

Where the reactor vessel comprises a tank reactor, the suspension product stream is continuously withdrawn from the tank reactor and is preferably, at least in part, continuously recycled to the high shear mixing zone(s), as described in WO 0138269 (PCT patent application number GB 0004444). This suspension recycle stream is preferably recycled to a high shear mixing zone(s) through an external conduit having a first end in communication with an outlet (for the suspension) of the tank reactor and a second end in communication with an inlet of the high shear mixing zone(s). The suspension may be recycled to the high shear mixing zone(s) via a mechanical pumping means, for example, a slurry pump, positioned in the external conduit. Owing to the exothermic nature of the Fischer-Tropsch synthesis reaction, the suspension recycle stream is preferably cooled by means of a heat exchanger positioned on the external conduit. Additional cooling may be provided by means of an internal heat exchanger comprising cooling tubes, coils or plates positioned within the suspension in the tank reactor. It is also envisaged that cooling may be provided solely by means of the internal heat exchanger i.e. the heat exchanger on the external conduit may be omitted. Preferably, the ratio of the volume of the external conduit (excluding the volume of any heat exchanger) to the volume of the tank reactor is in the range of 0.005:1 to 0.2:1.

Where the reactor vessel is a tank reactor, very good mixing can be achieved when the injector-mixing nozzle(s) is situated at the top of the tank reactor and the suspension recycle stream is removed from the tank reactor at its bottom, as described in WO 0138269 (PCT patent application number GB 0004444). Preferably, the injector mixing nozzle(s) discharges into the tank reactor in a substantially downwards direction (downshot nozzle(s)).

Where the process of the present invention is operated using a system comprising at least one high shear mixing zone, a tank reactor and an external conduit, the average residence time of the liquid phase (i.e. the liquid component of the suspension) in the tank reactor may be in the range of from 10 minutes to 50 hours, preferably, 1 hour to 30 hours. Suitably, the gas residence time in the high shear mixing zone(s) (for example, the injector-mixing nozzle(s)) is in the range 20 milliseconds to 2 seconds, preferably 50 to 250 milliseconds. Suitably, the gas residence time in the tank reactor is in the range 10 to 240 seconds, preferably 20 to 90 seconds. Suitably, the gas residence time in the external conduit is in the range 10 to 180 seconds, preferably 25 to 60 seconds.

For practical reasons the tank reactor may not be totally filled with suspension during the process of the present invention so that above a certain level of suspension a gas cap containing unconverted synthesis gas, methane by-product, carbon dioxide, water vapour, inert gases (for example, nitrogen), gaseous higher hydrocarbons and vaporized liquid higher hydrocarbons is present in the top of tank reactor. Suitably, the volume of the gas cap is not more than 40%, preferably not more than 30% of the volume of the tank reactor. The high shear mixing zone(s) may discharge into the tank reactor either above or below the level of suspension in the tank reactor or may be totally submerged below the level of suspension.

As discussed above a gaseous exit stream comprising unconverted synthesis gas, methane, carbon dioxide, inert gases, gaseous higher hydrocarbons, water vapour and vaporized liquid higher hydrocarbons is continuously withdrawn, either directly or indirectly, from the tank reactor and is, at least in part, continuously recycled to the high shear mixing zone(s), as described in WO 0138269 (PCT patent application number GB 0004444). Where the tank reactor has a gas cap, the gaseous exit stream is preferably withdrawn from the gas cap. A purge stream may be taken from the gaseous exit stream prior to recycling the gaseous exit stream to the high shear mixing zone(s), as described in WO 0138269 (PCT patent application number GB 0004444). Fresh synthesis gas may be introduced into this gaseous recycle stream also as described in WO 0138269 (PCT patent application number GB 0004444).

Where the reactor vessel is a tubular loop reactor comprising a tubular loop conduit, the high shear mixing zone(s) may be an injector-mixing nozzle(s), for example, of the types described above, which discharge their contents into the tubular loop reactor. Alternatively, the high shear mixing zone(s) may comprise at least one section of the tubular loop reactor containing a venturi plate. Preferably, the synthesis gas feed stream is introduced into the section(s) of the tubular loop reactor downstream of the venturi plate, for example, within 1 metres, preferably, within 0.5 metres of the venturi plate. In these arrangements, the suspension is circulated through the tubular loop reactor via a mechanical pumping means, for example, a slurry pump positioned therein. The high shear mixing zone(s) may also comprise at least one section of the tubular loop conduit containing a high shear pumping means, for example, a paddle or propeller having high shear blades. The synthesis gas feed stream is injected into the section(s) of the tubular loop reactor, for example, via a sparger, either upstream or downstream, preferably upstream of the high shear pumping means. Preferably, the synthesis gas feed stream is injected into the tubular loop reactor within 1 metre, preferably within 0.5 metres of the high shear pumping means. Without wishing to be bound by any theory, the high shear pumping means breaks down the synthesis gas feed stream into gas bubbles and/or irregularly shaped gas voids.

Preferably, the tubular loop reactor has at least 2 high shear mixing zones, preferably 2 to 25, for example, 2 to 10 high shear mixing zones spaced apart around the tubular loop reactor.

Where the system comprises at least one high shear mixing zone and a tubular loop reactor, the process of the present invention is preferably operated with an average residence time in the system of the liquid component of the suspension of between 10 minutes and 50 hours, preferably 1 to 30 hours. Suitably, the gas residence time in the high shear mixing zone(s) is in the range 20 milliseconds to 2 seconds, preferably 50 to 250 milliseconds. Suitably, the gas residence time in the tubular loop reactor (excluding any internal high shear mixing zone(s)) is in the range 10 to 420 seconds, preferably 20 to 240 seconds.

Where the reactor vessel is a tubular loop reactor, a gas cap is preferably omitted so as to mitigate the risk of slug flow. The product suspension stream together with entrained gases (gas bubbles and/or any irregularly shaped gas voids) and/or dissolved gases may be withdrawn from the tubular loop reactor and may be passed to an external gas separation zone where a gaseous phase comprising the entrained/dissolved gases separates from the suspension. This gaseous phase (comprising unconverted synthesis gas, carbon dioxide, methane, water vapour, inert gases, gaseous higher hydrocarbons, vaporized liquid higher hydrocarbons) may be recycled to the high shear mixing zone(s) as described in WO 0138269 (PCT patent application number GB 0004444). A purge stream may be taken from the gaseous recycle stream as described in WO 0138269 (PCT patent application number GB 0004444). Fresh synthesis gas may be introduced into the gaseous recycle stream also as described in WO 0138269 (PCT patent application number GB 0004444).

Preferably, a stream comprising a coolant liquid, for example, a low boiling hydrocarbon (such as methanol, ethanol, glycols, dimethyl ether, tetrahydrofuran, pentanes, hexanes or hexenes) or water may be introduced into the high shear mixing zone(s) and/or the reactor vessel as described in WO 0138269 (PCT patent application number GB 0004444). Where the continuous stirred reactor system comprises a tank reactor and an external conduit, the coolant liquid may be introduced into the external conduit. Where the coolant liquid is an oxygenate (for example, methanol or dimethyl ether) or an unsaturated hydrocarbon (for example, hexenes), the coolant liquid may be converted into higher hydrocarbons in the presence of the particulate Fischer-Tropsch catalyst.

Preferably, the ratio of hydrogen to carbon monoxide of the synthesis gas used in the process of the present invention is in the range 20:1 to 0.1:1 by volume, especially 5:1 to 1:1 by volume, typically 2:1 by volume.

Carbon dioxide may be present in the fresh synthesis gas feed in an amount of 0.1 to 50% by volume, preferably, 0.5 to 40% by volume, more preferably, 1 to 30% by volume, for example 2.5 to 25% by volume. Other components such as methane, inert gases, nitrogen and water may be present in the synthesis gas.

It may be advantageous to use a mixed particulate catalyst comprising a particulate Fischer-Tropsch catalyst and a particulate methanol synthesis catalyst in the process of the present invention. Thus, at least a portion of the carbon dioxide which is present in the fresh synthesis gas or which is generated as a by-product of the Fischer-Tropsch synthesis gas may react with hydrogen, in the presence of the methanol synthesis catalyst, to generate methanol. The methanol may then be converted into higher hydrocarbons in the presence of the Fischer Tropsch synthesis catalyst or may be isolated as a product.

Suitably, the carbon monoxide conversion to hydrocarbon products in the process of the present invention is in the range 1–95%, more preferably, 30–90%, most preferably, at least 65%, for example 50 to 90%.

As described in WO 0138269 (PCT patent application number GB 0004444), the synthesis gas may be prepared using any of the processes known in the art including partial oxidation of hydrocarbons, steam reforming, gas heated reforming, microchannel reforming (as described, for example, in U.S. Pat. No. 6,284,217 which is herein incorporated by reference), plasma reforming, autothermal reforming and any combination thereof (hereinafter collectively known as "reforming"). Preferably, the hydrocarbon feed to the reforming process is natural gas. A discussion of a number of these synthesis gas production technologies is provided in "Hydrocarbon Processing" V78, N.4, 87–90, 92–93 (April 1999) and "Petrole et Techniques", N. 415, 86–93 (July–August 1998). It is also envisaged that the synthesis gas may be obtained by catalytic partial oxidation of hydrocarbons in a microstructured reactor as exemplified in "IMRET 3: Proceedings of the Third International Conference on Microreaction Technology", Editor W Ehrfeld, Springer Verlag, 1999, pages 187–196. Alternatively, the synthesis gas may be obtained by short contact time catalytic partial oxidation of hydrocarbonaceous feedstocks as described in EP 0303438. Preferably, the synthesis gas is obtained via a "Compact Reformer" process as described in "Hydrocarbon Engineering", 2000, 5, (5), 67–69; "Hydrocarbon Processing", 79/9, 34 (September 2000); "Today's Refinery", 15/8, 9 (August 2000); WO 99/02254; and WO 200023689.

In yet a further embodiment of the present invention there is provided a process for the conversion of natural gas into higher hydrocarbons which comprises the steps of:

(a) reacting natural gas with steam and optionally oxygen in at least one reforming zone to produce a synthesis gas stream comprising 0.1 to 50% by volume of carbon dioxide, (b) feeding the synthesis gas stream, without separating the carbon dioxide, to a continuous stirred reactor system comprising a reactor vessel containing a suspension of a particulate Fischer-Tropsch catalyst suspended in a liquid medium wherein the Fischer-Tropsch catalyst is stable in the presence of carbon dioxide.

As discussed above, a gaseous exit stream comprising carbon monoxide, carbon dioxide, hydrogen, gaseous higher hydrocarbons and vaporized higher hydrocarbons may be withdrawn either directly or indirectly from the reactor vessel and may be at least in part recycled to the continuous stirred reactor system. Also, as described above, a purge stream may be taken from this gaseous recycle stream to prevent the build up of gaseous hydrocarbons, in particular, methane, in the continuous stirred reactor system. It is envisaged that this purge stream may be recycled to the reforming zone.

Preferably, the higher hydrocarbons produced in the process of the present invention comprise a mixture of hydrocarbons having a chain length of greater than 2 carbon atoms, typically greater than 5 carbon atoms. Suitably, the higher hydrocarbons comprise a mixture of hydrocarbons having chain lengths of from 5 to about 90 carbon atoms. Preferably, a major amount, for example, greater than 60% by weight, of the higher hydrocarbons have chain lengths of from 5 to 30 carbon atoms. Suitably, the liquid medium comprises one or more higher hydrocarbons which are liquid under the process conditions.

The catalyst which may be employed in the process of the present invention is any catalyst comprising cobalt which is known to be active in Fischer-Tropsch synthesis and which is stable in the presence of carbon dioxide. The catalyst is preferably stable in the presence of 50% by volume carbon dioxide, for at least 1000 hours on stream, preferably at least 2000 hours on stream.

A preferred catalyst comprises cobalt supported on an inorganic oxide support, preferably, a refractory inorganic oxide support selected from the group consisting of silica, alumina, silica-alumina and zinc oxide. The support generally has a surface area of less than about 100 $m^2/g$ but may have a surface area of less than 50 $m^2/g$ or less than 25 $m^2/g$, for example, about 5 $m^2/g$.

Suitably, the cobalt metal is present in catalytically active amounts of 2–50 wt %, preferably 10–40 wt % on the inorganic support. Promoters may be added to the catalyst and are well known in the Fischer-Tropsch catalyst art. Promoters can include ruthenium, platinum or palladium, aluminium, rhenium, hafnium, cerium, lanthanum, titanium, chromium and zirconium, and are usually present in amounts less than for cobalt metal (except for ruthenium which may be present in coequal amounts), but the promoter:metal ratio should be at least 1:10. Preferred promoters are rhenium and hafnium.

A particularly preferred catalyst is cobalt on zinc oxide. Other particularly preferred cobalt catalysts include catalysts comprising cobalt and at least one other metal chosen from the group formed by zirconium, titanium, ruthenium and chromium on a silica, alumina, or silica/alumina support. These catalysts are described in EP-A-142 887 which is herein incorporated by reference.

Preferably, the catalyst may have a particle size in the range 5 to 500 microns, more preferably 5 to 100 microns, most preferably, in the range 5 to 30 microns.

Preferably, the suspension of catalyst comprises less than 40% wt of catalyst particles, more preferably 10 to 30% wt of catalyst particles, most preferably 10 to 20% wt of catalyst particles.

The process of the invention is preferably carried out at a temperature of 180–380° C., more preferably 180–280° C., most preferably 190–240° C.

The process of the invention is preferably carried out at a pressure of 5–50 bar, more preferably 15–35 bar, generally 20–30 bar.

Preferably, the process of the present invention is operated with a gas hourly space velocity (GHSV) in the range in the range 100 to 40000 $h^{-1}$, more preferably 1000 to 30000 $h^{-1}$, most preferably 2000 to 15000, for example 4000 to 10000

$h^{-1}$ at normal temperature and pressure (NTP) based on the feed volume of synthesis gas at NTP.

Suitably, in the process of the present invention, the volumetric mass transfer rate is in the range 2 to 10,000, preferably, 25 to 1000, more preferably 5 to 100 kg-moles/h of carbon monoxide transferred per $m^3$ of suspension. Suitably, in the process of the present invention, the mass transfer rate is in the range $5\times10^{-3}$ to $5\times10^{-6}$ kg-moles carbon monoxide transferred per $m^2$ of bubble and/or irregularly shaped void surface area per hour.

The hydrocarbon products may be separated from the suspension, and may be purified and optionally hydrocracked, all as described in WO 0138269 (PCT patent application number GB 0004444).

EXAMPLES

The invention is illustrated by the following examples:

Example 1

A continuous stirred tank reactor may be operated under the conditions given in Table 1. The catalyst is stable for 1000 hours on stream in the presence of 27% by volume of carbon dioxide in the synthesis gas feed.

TABLE 1

| Continuous Stirred Tank Reactor Conditions | |
|---|---|
| Catalyst: | 40% by wt Co on a ZnO support |
| Catalyst charge | 20% by volume in the liquid medium (for example, tetradecane) |
| Synthesis gas feed | $H_2$:CO = 2:1; 27% by volume of $CO_2$ |
| Temperature | 227° C. |
| Pressure | 30 barg |
| CO Conversion | 95% |
| $C_{5+}$ Selectivity | 82% |
| $C_{5+}$ Productivity | 700 kg $m^{-3}$ catalyst $h^{-1}$ |
| Hours on Stream | 1000 |
| Stirrer Speed | 1200 rpm |
| GHSV | 6000 $h^{-1}$ |

Example 2

Approximately 5 g of an activated Co/ZnO Fischer Tropsch catalyst (20% w/w cobalt) was transferred under an inert gas blanket to a 1 litre stirred tank reactor containing approximately 300 ml of squalane. After transfer, the stirrer was turned on and a synthesis gas mixture (carbon monoxide 26.6%, nitrogen 20.2%, balance hydrogen) at a space velocity of 6000 $hr^{-1}$ was admitted to the tank reactor and the system pressure was increased to 425 psig. Gas leaving the tank reactor was passed through a water cooled knock-out pot to a system pressure controller before exiting the system. The temperature was raised over a period of 4 hours to 195° C. and was then increased at a rate of 2° C. every 3 hours to 220° C. The system was allowed to run under these conditions for a total on-stream time of 117.5 hours. The gas stream was then switched to a synthesis gas mixture containing carbon dioxide (carbon monoxide 26.3%, nitrogen 10.9%, carbon dioxide 9.2%, balance hydrogen) at a space velocity of 6000 $hr^{-1}$ and the experiment was continued. Analysis of the feed and exit gases was used to determine gas conversions.

| Hours on Stream | GHSV ($hr^{-1}$) | Temp (° C.) | Pressure (psig) | Conversion (mole %) CO | CO2 | Selectivity (Carbon mole %) FT Product |
|---|---|---|---|---|---|---|
| No carbon dioxide | | | | | | |
| 117 | 6000 | 220 | 424 | 42.7 | — | 90.3 |
| Carbon dioxide (9.2%) | | | | | | |
| 229 | 8000 | 221 | 431 | 42.4 | 0.0 | 91.4 |

The above Example shows that the CO conversion and selectivity of the cobalt on zinc oxide catalyst were unchanged when carbon dioxide was introduced to the stirred tank reactor. Thus, the cobalt on zinc oxide catalyst is stable in the presence of carbon dioxide and is suitable for use in a continuous stirred reactor system.

The invention claimed is:

1. A process for the conversion of natural gas into higher hydrocarbons, at an elevated temperature and pressure, which comprises the steps of:

(a) reacting natural gas with steam and optionally oxygen in at least one reforming zone to a produce synthesis gas stream comprising 0.1 to 50% by volume of carbon dioxide;

(b) feeding the synthesis gas stream, without separating the carbon dioxide, to a continuous stirred reactor system comprising a reactor vessel containing a suspension of a solid particulate Fischer-Tropsch catalyst suspended in a liquid medium wherein the solid particulate Fischer-Tropsch catalyst is stable in the presence of carbon dioxide and wherein the catalyst comprises cobalt on an inorganic oxide support selected from the group consisting of silica, alumina, silica-alumina and zinc oxide, wherein the synthesis gas is converted to higher hydrocarbons in a continuous stirred reactor system comprising at least one high shear mixing zone and a reactor vessel, wherein the synthesis gas feed stream and a suspension feed stream comprising the particulate Fischer-Tropsch catalyst suspended in a liquid medium are continuously fed to the high shear mixing zone(s), the shearing forces exerted on the suspension in the high shear mixing zone(s) are sufficiently high that the synthesis gas feed stream is broken down into gas bubbles and/or irregularly shaped gas voids and suspension having gas bubbles and/or irregularly shaped gas voids dispersed therein is discharged from the high shear mixing zone(s) into the reactor vessel.

2. A process as claimed in claim 1 wherein the volumetric mass transfer rate is in the range 2 to 10,000 kg-moles/h of carbon monoxide transferred per $m^3$ of suspension.

3. A process as claimed in claim 1 wherein the mass transfer rate is in the range $5\times10^{-3}$ to $5\times10^{-6}$ kg-moles carbon monoxide transferred per $m^2$ of bubble and/or irregularly shaped void surface area per hour.

4. A process as claimed in claim 1, wherein the reactor vessel is a tank reactor or a tubular loop reactor comprising a tubular loop conduit.

5. A process as claimed in claim 1 wherein the continuous stirred reactor system comprises up to 250 high shear mixing zones which discharge into or are located within a single reactor vessel.

6. A process as claimed in claim 1 wherein the volume of suspension present in the high shear mixing zone(s) is less than 20% of the volume of suspension present in the reactor vessel.

7. A process as claimed in claim 1 wherein the kinetic energy dissipation rate in the high shear mixing zone(s) is in the range 0.5 to 25 $kW/m^3$ relative to the total volume of suspension present in the continuous stirred reactor system.

8. A process as claimed in claim 1 wherein the average residence time of the liquid phase of the suspension in the reactor vessel is in the range of 10 minutes to 50 hours.

9. A process as claimed in claim 1 wherein the shearing forces exerted on the suspension in the high shear mixing zone(s) are sufficiently high that at least a portion of the synthesis gas feed stream is broken down into gas bubbles having diameters in the range of from 1 μm to 10 mm.

10. A process as claimed in claim 1 wherein the irregularly shaped gas voids are transient in that they are coalescing and fragmenting on a time scale of up to 500 ms.

11. A process as claimed in claim 1 wherein the high shear mixing zone(s) comprises an injector-mixing nozzle.

12. A process as claimed in claim 4 wherein the reactor vessel is a tank reactor and a product suspension stream is continuously withdrawn from the tank reactor and at least in part recycled to the high shear mixing zone(s) through an external conduit having a pumping means positioned therein.

13. A process a claimed in claim 12 wherein the suspension which is recycled to the high shear mixing zone(s) is cooled by means of a heat exchanger positioned on the external conduit.

14. A process as claimed in claim 12 wherein an internal heat exchanger is positioned within the suspension in the tank reactor.

15. A process as claimed in claim 12 wherein the high shear mixing zone(s) is an injector mixing nozzle(s) situated at or near the top of the tank reactor, the suspension is removed from the tank reactor at or near its bottom.

16. A process a claimed in claim 12 wherein a gas cap comprising unconverted synthesis gas, methane, carbon dioxide, water vapour, inert gases, gaseous higher hydrocarbons and vaporized liquid higher hydrocarbons is present in the tank reactor above the level of suspension and a gaseous exit stream is withdrawn from the gas cap and is at least in part recycled to the high shear mixing zone(s).

17. A process as claimed in claim 4 wherein the reactor vessel is a tubular loop reactor and the high shear mixing zone(s) is selected from:

(a) an injector-mixing nozzle(s) which discharges into the tubular loop reactor;

(b) an internal high shear mixing zone(s) comprising a venturi plate located in a section of the tubular loop conduit wherein the synthesis gas feed stream is introduced into the section of the tubular loop conduit downstream of the venturi plate; and (c) an internal high shear mixing zone comprising a high shear pumping means located in a section of the tubular loop conduit wherein the synthesis gas feed stream is introduced into the section of tubular loop conduit either upstream or downstream of the high shear pumping means.

18. A process as claimed in claim 17 wherein 2 to 25 high shear mixing zones are spaced apart around the tubular loop reactor.

19. A process as claimed in claim 17 wherein the tubular loop reactor is operated without a gas cap, a suspension product stream together with entrained gases and/or dissolved gases is continuously withdrawn from the tubular loop reactor and is passed to an external gas separation zone having a headspace therein wherein a gaseous phase separates from the suspension into the headspace, a gaseous exit stream is continuously withdrawn from the headspace and is at least in part is recycled to the high shear mixing zone(s).

20. A process as claimed in claim 1 wherein a vaporizable coolant liquid is introduced into the continuous stirred reactor system.

21. A process as claimed in claim 1 wherein fresh synthesis gas comprising 0.5 to 40% by volume carbon dioxide is continuously introduced into the continuous stirred reactor system.

22. A process as claimed in claim 1 wherein the catalyst comprises cobalt and at least one other metal selected from the group consisting of zirconium, titanium, ruthenium and chromium on a silica, alumina or silica/alumina support.

23. A process as claimed in claim 1 wherein the inorganic oxide support has a surface area of less than about 100 $m^2/g$.

24. A process as claimed in claim 1 wherein the cobalt metal is present in catalytically active amounts of 2–50 wt %, on the inorganic oxide support.

25. A process as claimed in claim 1 wherein the catalyst has a particle size in the range 5 to 500 microns.

26. A process as claimed in claim 1 wherein the suspension of catalyst comprises less than 40% wt of catalyst particles.

27. A process as claimed in claim 1 wherein the carbon monoxide conversion to hydrocarbon products is in the range 30–90%.

28. A process as claimed in claim 1 wherein a gaseous exit stream is removed either directly or indirectly from the reactor vessel, a purge stream is taken from the gaseous exit stream and is recycled to the reforming zone.

29. A process as claimed in claim 1 wherein the catalyst is stable in the presence of 50% by volume carbon dioxide, for at least 1000 hours on stream.

30. A process as claimed in claim 1 wherein the gas hourly space velocity (GHSV) is in the range 100 to 40000 $h^{-1}$, at normal temperature and pressure (NTP) based on the feed volume of synthesis gas at NTP.

* * * * *